US007955129B2

(12) United States Patent
Hu et al.

(10) Patent No.: US 7,955,129 B2
(45) Date of Patent: Jun. 7, 2011

(54) CAMERA SOCKET HAVING FOLD-BACK CONTACT TERMINALS ARRANGED IN HIGH DENSITY

(75) Inventors: Nan Hu, Shenzhen (CN); Gao-Bing Lei, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/780,950

(22) Filed: May 17, 2010

(65) Prior Publication Data

US 2011/0034077 A1 Feb. 10, 2011

(51) Int. Cl.
*H01R 13/648* (2006.01)

(52) U.S. Cl. ..... 439/607.01

(58) Field of Classification Search ..... 439/607.01, 439/71–72, 496, 83, 246–248
See application file for complete search history.

(56) References Cited

U.S. PATENT DOCUMENTS

| | | | | |
|---|---|---|---|---|
| 5,310,357 | A * | 5/1994 | Olson | 439/346 |
| 7,442,082 | B2 * | 10/2008 | Ma | 439/607.01 |
| 7,445,506 | B2 * | 11/2008 | Ma | 439/607.01 |
| 7,497,733 | B1 * | 3/2009 | Van der Steen | 439/607.01 |
| 7,651,338 | B2 | 1/2010 | Miyamoto et al. | |
| 7,717,744 | B2 * | 5/2010 | Ma | 439/607.1 |
| 2006/0189216 | A1 * | 8/2006 | Yang | 439/680 |
| 2008/0182452 | A1 * | 7/2008 | Ma | 439/607 |
| 2008/0220663 | A1 * | 9/2008 | Ma | 439/733.1 |

* cited by examiner

*Primary Examiner* — Jean F Duverne
(74) *Attorney, Agent, or Firm* — Andrew C. Cheng; Wei Te Chung; Ming Chieh Chang

(57) ABSTRACT

A camera socket (100) includes a metallic housing (40) defining a receiving space (101), a contact terminal insert disposed within the metallic housing (40) and including a plurality of contact terminals (30) integrally formed with an insulative housing (20) and arranged in an array. Each contact terminal (30) includes a fold-back contact engaging arm (34) extending backwardly and offset from a main portion (33) of the contact terminal (30) in a way such that a free end (341) of each of the contact engaging arm is located adjacent to a sidewall (41) of the metallic housing (40) for engaging with a camera module (100*a*).

4 Claims, 4 Drawing Sheets

CAMERA SOCKET HAVING FOLD-BACK CONTACT TERMINALS ARRANGED IN HIGH DENSITY

BACKGROUND OF THE INVENTION

1. Field of the Invention

The present invention relates to a camera socket, and more particularly, to a camera socket having contact terminals with fold-back contact engaging arms arranged in high density suitable for application in which miniaturization is required.

2. Description of the Related Art

U.S. Pat. No. 7,651,338 issued to Miyamoto et. al on Jan. 26, 2010, discloses a camera socket for connecting two connection objects faced to each other. The camera socket includes a contact module for electrically engaging with said two objects. The contact module has an insulative base and a plurality of conductive contacts retained therein. Each of the contacts includes a holding portion held by the insulative base, a first spring portion extending from one side of the holding portion in a first direction, and a second spring portion extending from an intermediate area of the first spring portion in a second direction substantially opposite to the first direction. The first spring portion defines a first contacting portion at its free end opposite to the holding portion for connecting with one of said objects. The second spring portion has a second contacting portion at its free end for connecting with another object.

Moreover, the first spring portion defines an opening extending from the vicinity of the first contacting portion towards the holding portion. Then the second spring portion is formed by a folded cantilevered tab carved out from said opening. However, configuration and geometry of the contact is comparably complicated, especially the configuration of the first and the second spring portions thereof, therefore more manufacturing procedures are needed. Each of the first spring portions has a pair of connecting arms formed with said opening for connecting between the holding portion and the first contacting portion. In such a manner that the contact will occupy most of the room in a transversal direction of the contacts arranged.

Therefore, an improved electrical connector is desired to overcome the disadvantages of the related arts.

SUMMARY OF THE INVENTION

An object of the present invention is to provide a camera socket overcoming disadvantage of the prior art in which its contact terminals are unfavorable to miniaturization and simplification thereof.

In order to achieve the above-mentioned object, a camera socket in accordance with a preferred embodiment of the present invention includes a metallic housing defining a receiving space, a contact terminal insert disposed within the metallic housing and including a plurality of contact terminals integrally formed with an insulative housing and arranged in an array. Each contact terminal includes a fold-back contact engaging arm extending backwardly and offset from a main portion of the contact terminal in a way such that a free end of each of the contact engaging arm is located adjacent to a sidewall of the metallic housing for engaging with a camera module.

Other objects, advantages and novel features of the invention will become more apparent from the following detailed description of the present embodiment when taken in conjunction with the accompanying drawings.

DETAILED DESCRIPTION OF THE INVENTION

Figure 1:
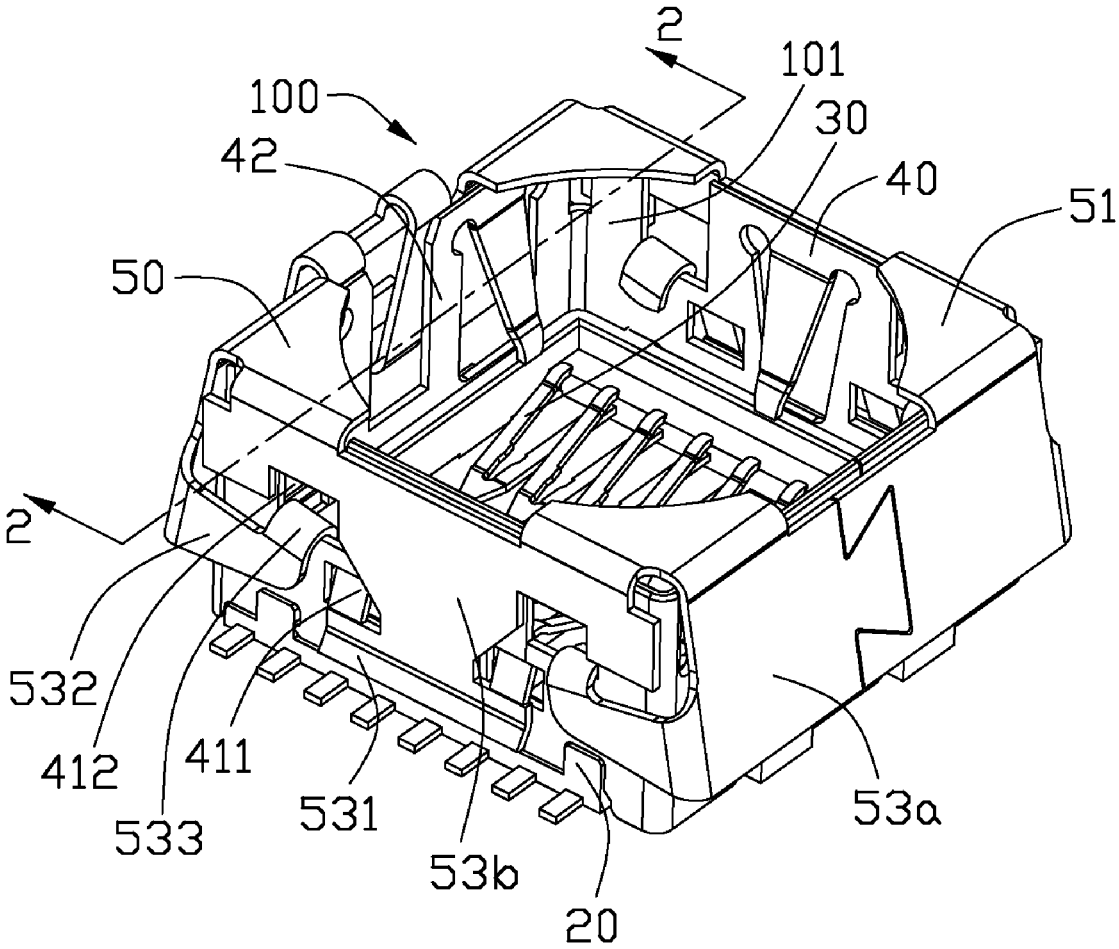
FIG. 1 is a perspective view of a camera socket in accordance with the preferred embodiment of the present invention.

Reference will now be made to the drawing figures to describe the preferred embodiment of the present invention in detail.

Figure 2:
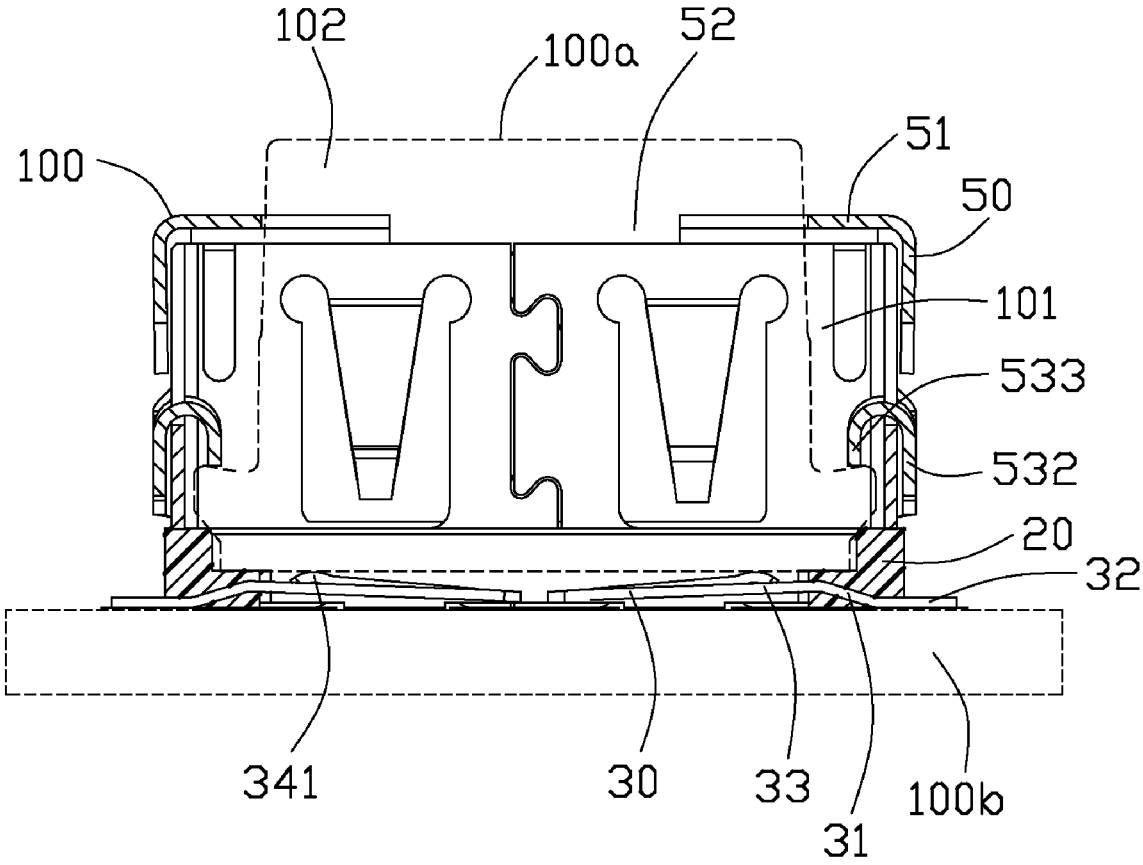
FIG. 2 is a cross-section view of the camera socket taken along line 2-2 of FIG. 1 with showing a fictitious inserted camera and a fictitious printed circuit board.

Referring to FIGS. 1 and 2, a camera socket 100 which can electrically interconnect a camera module 100*a* and a printed circuit board (PCB) 100*b* is shown. Cooperation with FIG. 3, the camera socket 100 includes an insulative housing 20 defining a pair of first walls 21 and a pair of second walls 22 connecting with both ends of the first wall 21, thereby forming a hollowed frame configuration. The camera socket 100 also includes a plurality of contact terminals 30 integrally assembled to the insulative housing 20 thereby forming a contact terminal insert, and a metallic housing 40 attached to the insulative housing 20 from a top so that the contact terminal insert is disposed within thereof and shielded by the metallic housing 40. The contact terminals 20 are integrally formed with each of the first walls 21 and arranged in an array in a longitudinal direction along the first wall 21. The metallic housing 40 includes two first side walls 41 and two second side walls 42 respectively standing on the first walls 21 and second walls 22 thereby forming a receiving space 101 for receiving the camera module 100*a* therein.

Figure 3:
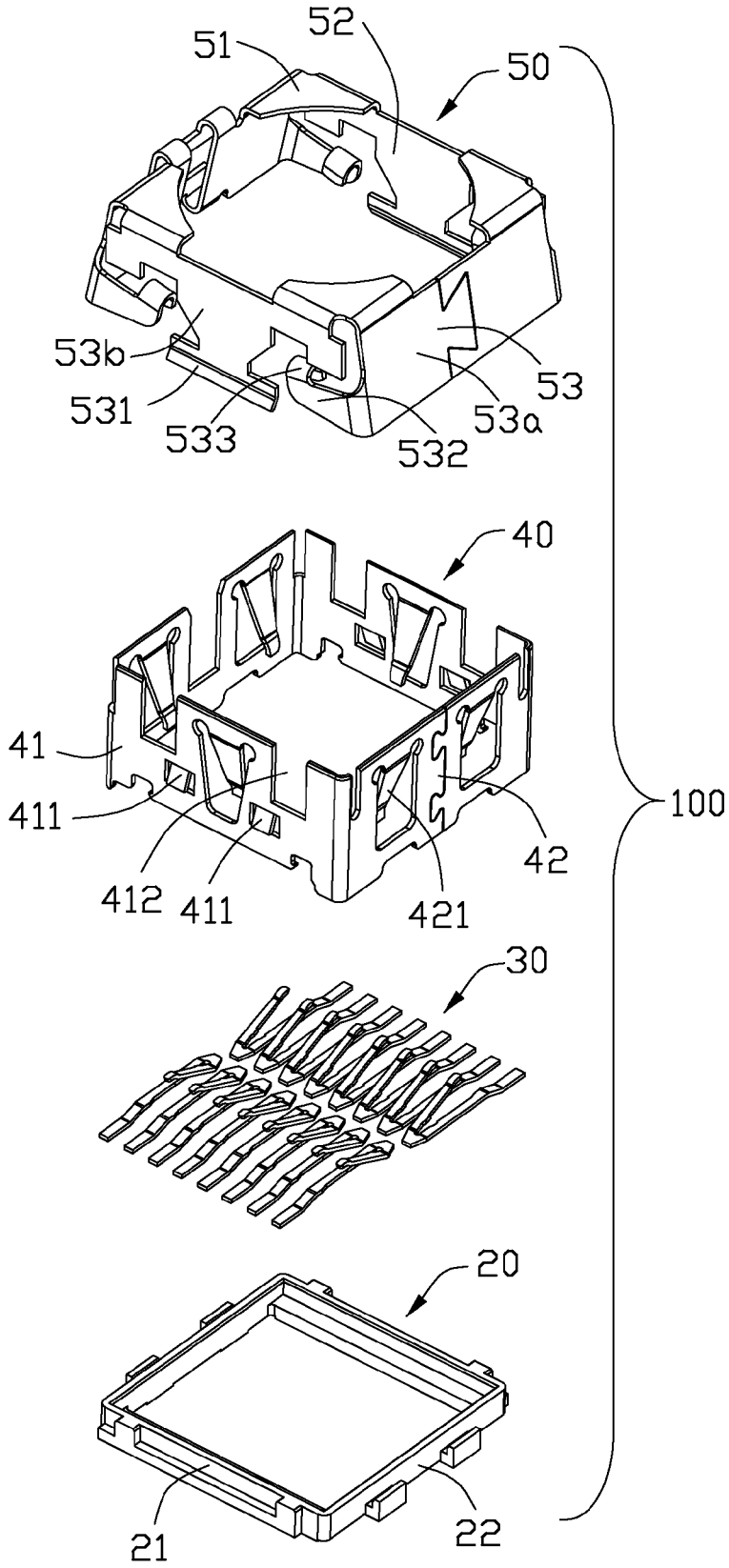
FIG. 3 is an exploded perspective view of FIG. 1.
Figure 4:
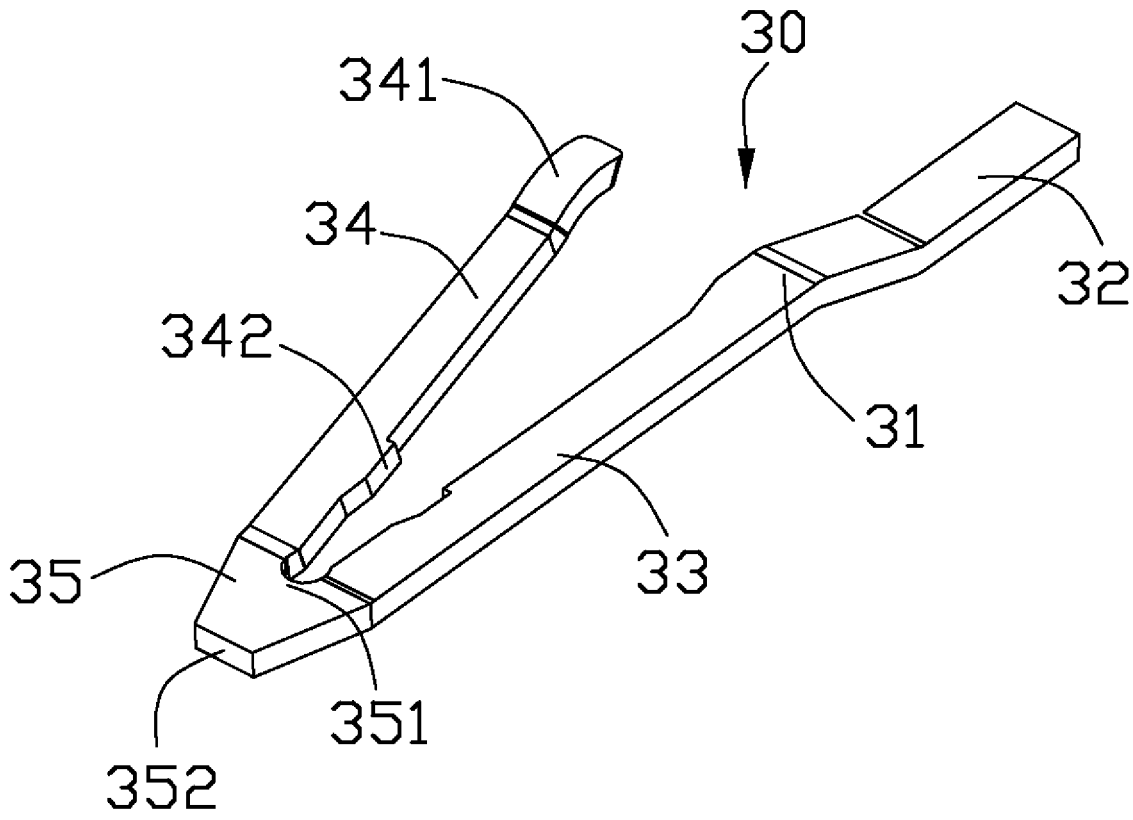
FIG. 4 is a perspective view of a contact terminal of FIG. 3.

Referring to FIGS. 3 and 4, the first wall 21 is regarded as a terminal receiving area for the contact terminals received therein. The contact terminal 30 includes a holding portion 31 integrally retained in the insulative housing 20 by means of insert molding, a soldering portion 32 extending outwards from one end of the holding portion 31 for capable of being soldered to the PCB (as best seen from the FIG. 2), a cantilevered spring connecting arm 33, i.e. a main portion extending from the other end of the holding portion 31 in a transverse direction perpendicular to the longitudinal direction, and a fold-back contact engaging arm 34 extending backwardly from a free end of the connecting arm 33. Moreover, the contact engaging arm 34 is located below the connecting arm 33 and extends towards the receiving space 101 for engaging with the camera module 100*a*, in a way such that a contacting portion 341 at its free end is located adjacent to first side wall 41 of the metallic housing 40 for electrically connecting with the camera module 100*a*.

The contact engaging arm 34 is cut off from outer edge of the connecting arm 33. So the contact engaging arm 34 is offset from the spring connecting arm 33 in the longitudinal direction, i.e. the contact engaging arm 34 is located adjacent to the connecting arm 33 in a side-by-side manner substantially, in such a manner that it will be favorable for simplifying the structure of the contact terminal 30 for lowered cost. Moreover, the connecting arm 33 of one contact terminal 30 is located adjacent to the contact engaging arm 34 of another adjacent contact terminal 30 in the longitudinal direction.

Accordingly, the pitch of two adjacent contact terminals 30 could be decreased than before for miniaturization.

Referring to FIGS. 1 to 3, when the camera module 100*a* is disposed into the receiving space 101, a shield cover 50 of the camera socket 100 is enveloped onto the metallic housing 40 from a top for covering the camera module 100*a*. The shield cover 50 has a top shutter 51 shrouding a top side of the receiving space 101 with an opening 52 for protrusion 102 of the camera module 100*a* and four side shutters 53 shielding the metallic housing 40. The side shutters 53 includes a first side shutter 53*a* locking with the first side wall 41 of the metallic housing 40 and a second side shutter 53*b* adjacent to the two first side shutters 53*a*. The metallic housing 40 has a plurality of grounding fingers 421 protruding into the receiving space from the first side walls 41 and the second side walls 42 for grounding.

The first side shutter 53*a* defines a horizontal positioning tab 531 engaging with a locking tab 411 of the first side wall 41 correspondingly for preventing the shield cover 50 from moving away upwards. The second side shutter 53*b* has at least one locking arms 532 folding and extending towards the first side shutter 53*a*. The first side wall 41 of the metallic housing 40 defines a recess 412 receiving the locking arms 532 of the shield cover 50 extending into the receiving space 101. The locking arm 532 includes a locking portion 533 pressing against the camera module 100*a* for preventing the module from moving upwards.

The contact terminal 30 includes a connecting portion 35 connecting the spring connecting arm 33 with the contact engaging arm 34. When the camera module 100*a* is located on a final position, the contact engaging arm 34 is pressed downwards by the camera module 100*a* and driving the connecting arm 33 to be deformed elastically, especially the connecting portion 35 will bear bigger stress from the camera module 100*a*. The connecting portion 35 defines a free end portion 352 and a connecting end 351 located near to holding portion 31. The connecting end 351 is wider than the free end portion 352 in the longitudinal direction. Therefore, the free end portion 352 is capable of bearing bigger stress from the camera module 100*a* than the connecting end 351, i.e. the narrower free end portion 352 is regarded as a stress-absorbing area for protecting connecting end 351 from being deformed. The connecting portion 35 is configured in a trapezoid shape in a way which can be easily manufactured. On the other hand, the stress can also be prevented from surging incidentally. Furthermore, the contact engaging arm 34 includes a protruding portion 342 expanding outwards in the longitudinal direction for increasing strength of the contact engaging arm 34 at the vicinity of the protruding portion 342. The location of the protruding portion 342 is based on result of calculations and testes.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A socket for receiving a camera module, comprising:

a metallic shell surrounding a camera module receiving cavity;

an insulative plate located below said receiving cavity;

a plurality of contacts each including:

a holding portion secured to the housing;

a solder portion extending from the holding portion outwardly in a first longitudinal direction;

a resilient connecting arm extending from the holding portion inwardly in a second longitudinal direction opposite to the first longitudinal direction; and a connecting portion located at a free end of the connecting arm; and a contact engaging arm obliquely upwardly extending from the connection portion, and in a top view extending in the first longitudinal direction and essentially being parallel to the connecting arm with a predetermined gap therebetween, a contacting portion located at a free end of the contact engaging arm for contacting the camera module; wherein the contact engaging arm defines a transverse expanded section for increasing normal force thereof, and the connecting arm defines a transverse narrowed section for decreasing stress thereof, said transverse expanded section and said transverse narrowed section being located at essentially a same longitudinal position in said first longitudinal direction in the top view; wherein the connecting portion define a joint linked to both said contact engaging arm and the connecting arm, and a transverse dimension of said joint in a transverse direction perpendicular to said first direction is larger than that of the solder portion which is larger than that of the connecting arm and that of the contact engaging arm.

2. The socket as claimed in claim 1, wherein said expanded section defines a protrusion facing a recess defined by said narrowed section.

3. The socket as claimed in claim 1, wherein said connecting portion defines a pair of oblique side edges each extending at a free end thereof and terminating at a joint with said contact engaging arm and said connecting arm for decreasing stress.

4. The socket as claimed in claim 1, wherein the connecting portion define a joint linked to both said contact engaging arm and the connecting arm, and a transverse dimension of said joint in a transverse direction perpendicular to said first direction is larger than that of the solder portion which is larger than that of the connecting arm and that of the contact engaging arm.

* * * * *